US005341944A

United States Patent [19]

Latino

[11] Patent Number: 5,341,944

[45] Date of Patent: Aug. 30, 1994

[54] MODULAR LIBRARY SYSTEM WITH STATIONARY AND MOBILE RACKS FOR STORAGE OF COMPUTER CATRIDGES

[75] Inventor: Richard M. Latino, Sterling, Mass.

[73] Assignee: Wright Line, Inc., Worcester, Mass.

[21] Appl. No.: 4,457

[22] Filed: Jan. 14, 1993

[51] Int. Cl.[5] ..... A47F 5/00

[52] U.S. Cl. ..... 21/162; 211/94

[58] Field of Search ..... 211/162, 94, 41, 40, 211/126; 312/201

[56] References Cited

U.S. PATENT DOCUMENTS

D. 300,287 3/1989 Price et al. .
D. 300,288 3/1989 Price et al. .
2,098,828 11/1937 Ludwick .
2,633,810 4/1953 Freeman .
2,690,136 9/1954 Freeman .
4,008,807 2/1977 Phillips ..... 211/162 X
4,600,107 7/1986 Price et al. .
4,657,317 4/1987 Gemma ..... 211/162 X
4,684,027 8/1987 Wright .
4,688,682 8/1987 Price et al. .
4,782,958 11/1988 Price et al. .
4,815,795 3/1989 Accumanno et al. .
4,844,564 7/1989 Price, Sr. et al. .
4,846,355 7/1989 Price, Sr. et al. .
4,898,283 2/1990 Kingsford .
4,898,284 2/1990 Arens .
4,971,199 11/1990 Price, Jr. et al. .
4,982,852 1/1991 Johansen .
5,062,535 11/1991 Potter .
5,072,838 12/1991 Price, Jr. et al. ..... 211/162
5,193,696 3/1993 Price, Jr. et al. ..... 211/162
5,226,549 7/1993 Price, Jr. et al. ..... 211/162

*Primary Examiner*—Alvin C. Chin-Shue
*Assistant Examiner*—Sarah A. Lechok
*Attorney, Agent, or Firm*—Cesari and McKenna

[57] ABSTRACT

A modular library system for computer cartridges has stationary and mobile racks. Each of the racks comprises a plurality of spaced "T" shaped vertical supports. The vertical supports define vertical spaces for receiving cartridge holding trays or packs. The "T" shaped supports have tabs for holding the packs. The "T" shaped supports are interconnected by a top panel, a rear panel, a mounting base and a spreader. The spreader interlinks with all the vertical supports for providing structural rigidity.

2 Claims, 12 Drawing Sheets

MODULAR LIBRARY SYSTEM WITH STATIONARY AND MOBILE RACKS FOR STORAGE OF COMPUTER CATRIDGES

FIELD OF THE INVENTION

This invention relates to modular library systems that are specifically adapted for storage and retrieval of computer cartridges, and more particularly to such library systems that employ both stationary and side-sliding mobile racks.

BACKGROUND 0F THE INVENTION

U.S. Pat. No. 5,062,535 issued to Potter on Nov. 5, 1991, discloses a module library system having stationary and mobile racks. Each rack has vertical side panels that support a number of horizontal, cartridge-holding shelves. The stationary racks are arranged in two back-to-back rows, each having a plurality of racks arranged side-to-side. The open fronts of the stationary racks of one row face in a direction opposite to that of the other row.

The stationary racks in each row are connected side-to-side by spacers that fasten (e.g., using bolts) between upper and lower side walls of adjacent racks. Each rack is supported by a mounting base.

The mobile racks are arranged for side sliding motion in front of the rows of stationary racks so as not to block access to cartridges stored in the stationary racks. The mobile racks have rollers that ride on upper and lower tracks connected to the stationary racks.

In that patent, a break system is providing for stopping the movement of the mobile racks at selected locations along the tracks. The brake system includes padded members mounted to selected mobile racks, and stop members mounted to selected stationary racks, e.g., the stationary rack nearest the end of the row along which the mobile rack slides. As the mobile unit nears the end of its horizontal travel, the padded member frictionally engages the stop member, thereby abruptly stopping the mobile unit.

The system disclosed in that patent is generally suited to its intended purposes. Nevertheless there are certain areas in which improvements could be made. For instance, one problem encountered with that design in some applications is inadequacy of structural rigidity of the racks. This can be particularly acute where the racks are of significant height, e.g., near room height, and are of significant width. Such racks are particularly subject to a condition known as "racking," i.e., displacement of the sides of the racks out of plumb when the racks are loaded. Any solution to that problem, however, has to preserve the modularity of the library system, and permit easy assembly and disassembly of the racks.

Another area that could be improved is the braking system. The braking members disclosed in that patent can "jam" under certain circumstances when excessive engagement forces are applied, thus rendering it difficult to disengage or release the brakes. For example, this can happen when a user pushes one of the mobile racks too hard, causing it to move at a high speed, thereby causing the brake members to "over" engage with one another.

Yet another area deserving of attention is the track arrangements on which the mobile racks ride. It would be desirable to improve the mechanical strength and structural rigidity of the upper and lower track arrangements, and to provide an improved track design that prevents or at least reduces derailment, e.g., during braking.

Accordingly, it would be desirable to provide a new and improved library system that overcomes a number of these and other drawbacks with the known design.

SUMMARY OF THE INVENTION

The invention resides in a modular library system for computer cartridges, in which each rack is formed from a plurality of vertical troughs arranged side by side. Each trough is of a unitary (i.e., integral, one piece) construction, with a squared-off "U"-shaped cross-section. Accordingly, each trough defines a vertically elongated space for receiving, e.g., a stack of removable cartridge-holding trays or packs. Side walls of adjacent troughs form double-thick, rigid, vertical partition walls separating the vertical spaces within each rack. The partition walls have tray-supporting features to retain the cartridge-holding trays, but in the preferred embodiment, are not intended to support shelves, as in the prior art.

The troughs have trough-to-trough connecting features along their forward vertical edges. Specifically, each trough has a male connecting feature along one edge (e.g., a tab running along its entire length), and a female connection feature along the other (e.g., a groove running along its entire length). The troughs are arranged so that the male connecting feature of one trough mates within the female connecting feature of the adjacent trough in "tongue in groove" fashion. This arrangement causes each partition wall to be of compound construction in that it comprises the side walls of the two neighboring troughs, thus providing structural rigidity.

To improve structural rigidity even more, a number of vertically-spaced, rigid, horizontal straps, called "spreaders," extend along the width of each rack, and interlock the side walls of the troughs forming each rack. A spreader lock bar holds the spreader in place proximate its ends.

Each rack has a mounting base to which its troughs are secured. The mounting base has a novel, "box within a box" construction. The base includes an outer box, e.g., of sheet metal, and a plurality of so-called inner boxes, each comprising a pair of parallel bracing elements that extend from the front to the rear of the rack. The troughs extend through the outer box and are secured to the inner box, e.g., by welding, so as to fixedly and rigidly anchor the troughs along the bottoms of the partition walls and along their rear walls.

Accordingly, the racks are of an improved design that provides structural rigidity owing to the double thick partition walls, the solid rear walls of the troughs, the "box in a box" construction of the mounting bases, the tongue-in-groove trough interconnect system and the spreaders. This arrangement is designed so that the modular library system can be readily expanded by the addition of racks, readily assembled and readily disassembled.

In an alternative embodiment of the invention, each rack is formed of "T" shaped vertical supports instead of the troughs described above. The T-supports, as they can be conveniently called, are each of unitary construction, being formed from, e.g., sheet metal that is bent over upon itself in the middle to provide the "central" elements of the "T" shape, and then flared at ninety degrees at each end (distal from the bend) to provide rear wall elements. The central elements form double-thick, rigid, vertical partition walls, which separate the cartridge-pack-receiving vertical spaces within each rack. As with the other embodiment, the partition walls have tray-supporting features to retain the cartridge-holding trays. Preferably these features are formed by bending out short tabs of material from the T-supports, and thus do not require assembly on the T-supports.

The T-supports are secured in an upright position and provided with structural rigidity by a spreader, as described above, and by attachment of the T-supports of each rack to a top panel and to the bracing elements of the mounting base. The spreader also serves to-keep the central elements of the T-supports parallel, thereby maintaining the dimensional integrity (i.e., preserving the uniform rectangular cross-section) of the vertical spaces therebetween. To that purpose also, a rear panel attached to the rear wall elements of the T-supports of each rack interconnects the T-supports intermediate the top panel and the mounting base.

The spreader is preferably of a simpler construction, which has spaced notches that interfit with forwardly located notches in the central elements of the T-supports. The spreader interlocks with the vertical supports located at each end of the rack by fitting locking tabs on ends of the spreader through mating slots on those end supports, and then bending or twisting the tabs to lock the spreader in place.

This alternative arrangement provides racks of lighter weight for easier handling, e.g., during manufacture (e.g., welding and painting).

In another aspect of the invention, an improved track arrangement is provided. The lower track is formed as a monorail that is connected by spaced attachment cylinders to the base of the stationary rack. The improved mechanical strength of the mounting base provided by its "box in a box" construction, as described above, improves the structural rigidity of the lower track arrangement thereby reducing the likelihood of derailment. In addition, the roller arrangement for the top track has anti-derailment features to prevent the top roller from being forced vertically out of the top track, e.g., during braking. These features include horizontal retention plates that retain the top roller within a channel formed in the top track.

In accordance with yet another aspect of the invention, the modular library system has a dual-action brake system. The brake system includes a wear pad located on a "floating" element suspended by springs from a mounting bracket attached to the mobile rack, and a brake cam or ramp located on the stationary rack nearest the end of the row of stationary racks. During braking of the mobile rack, the wear pad bears with increasing force against the ramp as the mobile rack nears the end of its travel so as to provide gradual deceleration. As a result, releasing the brake is not difficult since the brake will almost never be "over" engaged, as in the prior art discussed above.

The brake system also includes a safety stop so as to assure an absolute limit of travel of the mobile rack to prevent derailment at the end of the track. The safety stop is in the form of an adjustable contact plate mounted on each mobile unit, which can engage with the ramp on the stationary rack at any predetermined and adjustable position along the ramp. By adjusting the position of engagement of the contact plate along the ramp, the location of the hard stop achieved by the interaction of those components can be controlled. Preferably, the safety stop engages the ramp after the brake has caused the mobile rack to decelerate to a low enough speed to assure that the safety stop does not "over" engage with the ramp.

Thus, the invention provides a dual-action braking system which decelerates the mobile rack by means of the floating element, and can bring the mobile rack to a hard stop (if need be) by means of the adjustable safety stop.

BRIEF DESCRIPTION OF THE DRAWINGS

The above and further advantages of the invention may be better understood by referring to the following description in conjunction with the accompanying drawings, in which.

DETAILED DESCRIPTION OF ILLUSTRATIVE EMBODIMENTS

Figure 1:
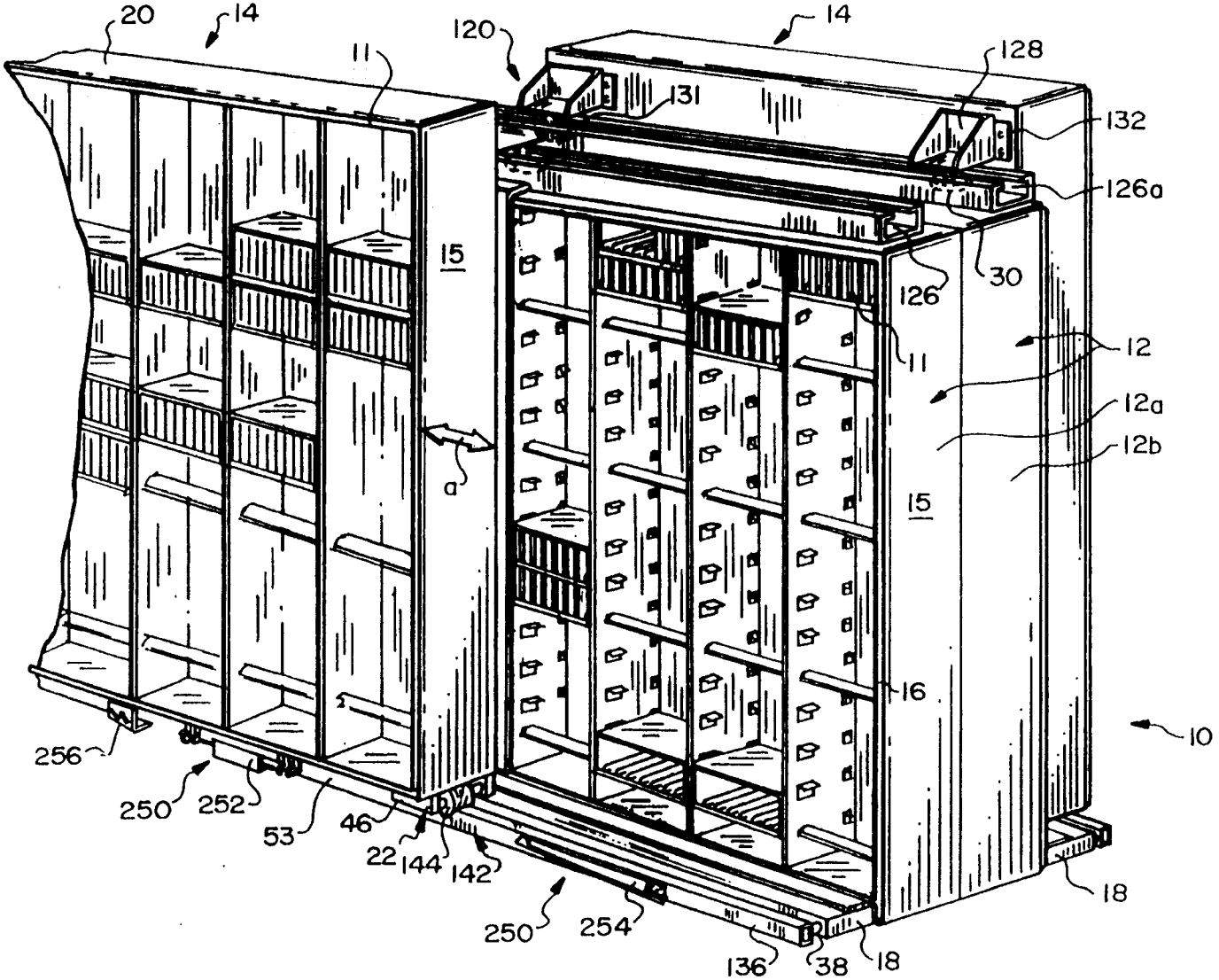
FIG. 1 is a perspective view of a modular library system for storage of computer cartridges in accordance with the invention.
Figure 2:
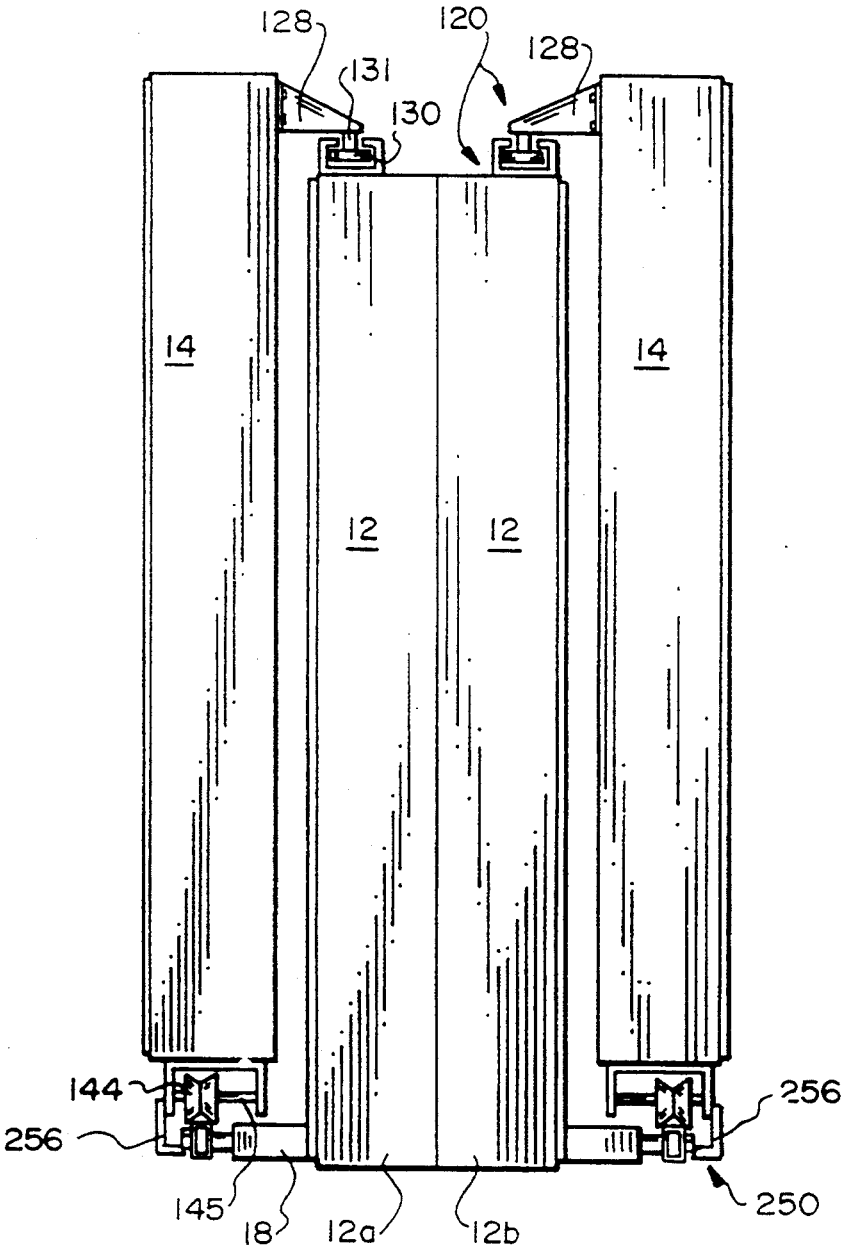
FIG. 2 is a side view of the modular library system of FIG. 1, showing the upper and lower track arrangements for the mobile racks.

FIGS. 1 and 2 show a modular library system 10 for storage and retrieval of computer cartridges 11 in accordance with a preferred embodiment of the invention. The modular library system 10 has a number of stationary racks 12 and a number of mobile racks 14.

The stationary racks are arranged in two back-to-back, parallel rows 12*a*, 12*b*, each having a plurality of racks arranged side-to-side between vertical end panels 15. The open fronts 16 of the stationary racks of row 12*a* face in a direction opposite to that of the other row 12*b*. The stationary racks 12 are supported on mounting bases 18.

Each mobile rack 14 is disposed for side sliding motion in the direction of arrow "a" in front of (and parallel to) an associated one of rows 12*a*, 12*b* of stationary racks 12 so as not to block access to cartridges 11 stored in the stationary racks 12.

Aspects of the invention can also be practiced in an alternate embodiment using a single row 12*a* or 12*b* of stationary racks 12 and at least one mobile rack 14 movable along that row.

a. Rack Construction

FIGS. 3A–6 show details of the modular construction of the racks 12, 14 of the modular library system 10. Each rack 12, 14 is formed from a plurality of vertical troughs 22 arranged side by side. Different width racks 12, 14 are provided by inclusion of a different number of the troughs 22 in each. A top panel 20 (FIG. 1) closes the top of the troughs 22.

Each trough 22 is of a unitary construction, preferably of metal, with a generally uniform, squared-off "U"-shaped cross-section. Each trough 22 has first and second, general parallel side walls 24, 26 and a rear wall 28 bridging perpendicularly between rear edges of the side walls 26, 24.

Each trough 22 thus defines a vertically elongated space 32 for receiving, e.g., a stack of removable cartridge-holding, open-fronted, box-like trays or packs 34, of which only one is shown for illustrative purposes. The packs 34 are supported by tab-like elements 36, which are preferably stamped out of the side walls 26, 24 of adjacent troughs 22 and extend a short distance into the vertical spaces 32. The side walls 26, 24 form double-thick, rigid, vertical partition walls 38 separating the vertical spaces 32 within each rack 12, 14.

Figure 3A:
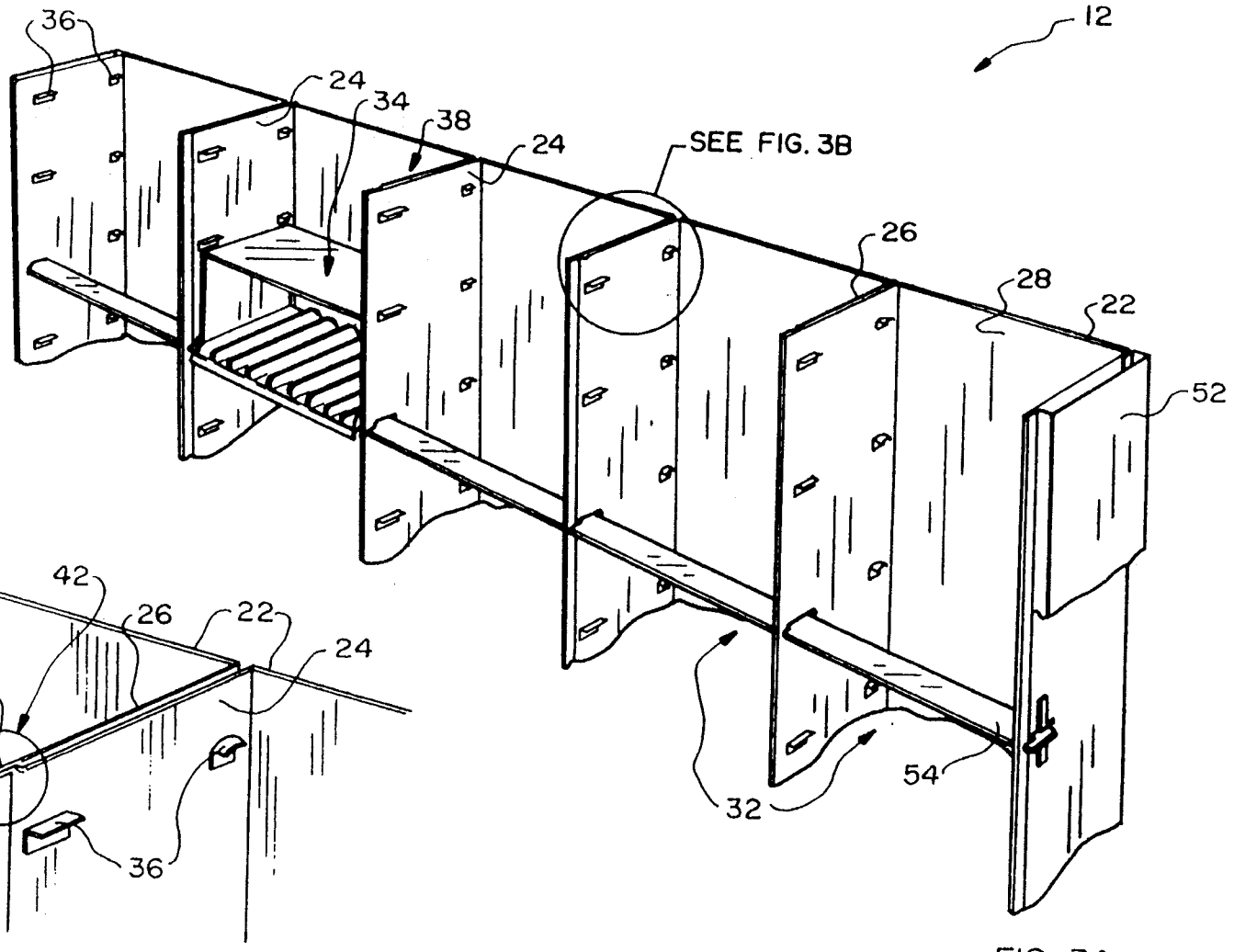
FIG. 3A is a perspective view of the trough construction of each rack of the modular library system of FIG. 1, which also shows the spreader interlocking with the troughs.
Figure 3B:
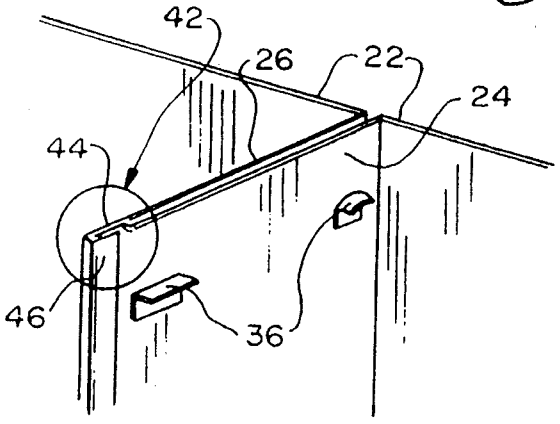
FIG. 3B is an enlarged, detail view of a portion of FIG. 3A, showing trough connecting features.

As shown best in FIG. 3B, the troughs 22 have trough-to-trough connecting features 42 along their forward vertical edges. Specifically, each trough 22 has a male connecting feature 44 along one edge, e.g., the edge of side wall 24, and a female connecting feature 46 along the other, e.g., the edge of side wall 26. The male connecting feature 44 is fashioned, for example, as a continuous tab or tongue running along the entire length of the side wall 24. The female connection feature is provided, for example, as a continuous groove running along the entire length of side wall 26. The troughs 22 are arranged so that the male connecting feature 44 of one trough 22 is disposed within the female connecting feature 46 of the adjacent trough 22 so as to engage one another in "tongue in groove" fashion.

Alternatively, if it is so desired, troughs having only female connecting features can be disposed in alternation in the rack with troughs having only male connecting features rather than providing both types of connecting features on each trough.

Generally speaking, either arrangement causes each partition wall 38 to be of compound construction in that it comprises the interlocked side walls 26, 24 of the two neighboring troughs 22, thus providing structural rigidity.

Some of the racks 12, 14 also have the end panels 15, mentioned above, as shown in FIGS. 1 and 3A. The end panels 15 are connected to the "free" (i.e., unattached) side walls of the troughs 22 located at the ends of the movable rack 14, and to the free ends of the rows 12*a*, 12*b* of the stationary racks 12. In either case, the end panels 15 are connected to the end-located troughs 22 using preferably the above-described "tongue in groove" arrangement, and/or by other conventional expediency.

Figure 4:
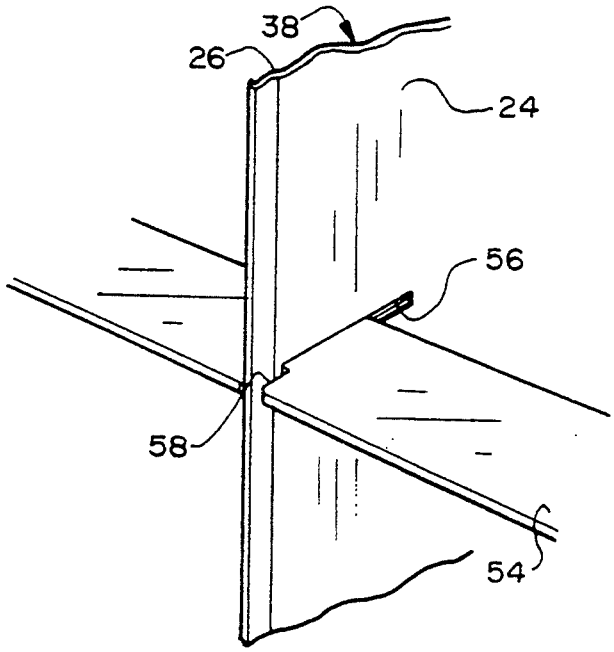
FIG. 4 an enlarged, perspective view of the interlocking arrangement between the spreader and the double-thick partition walls of the troughs of FIG. 3A.
Figure 5:
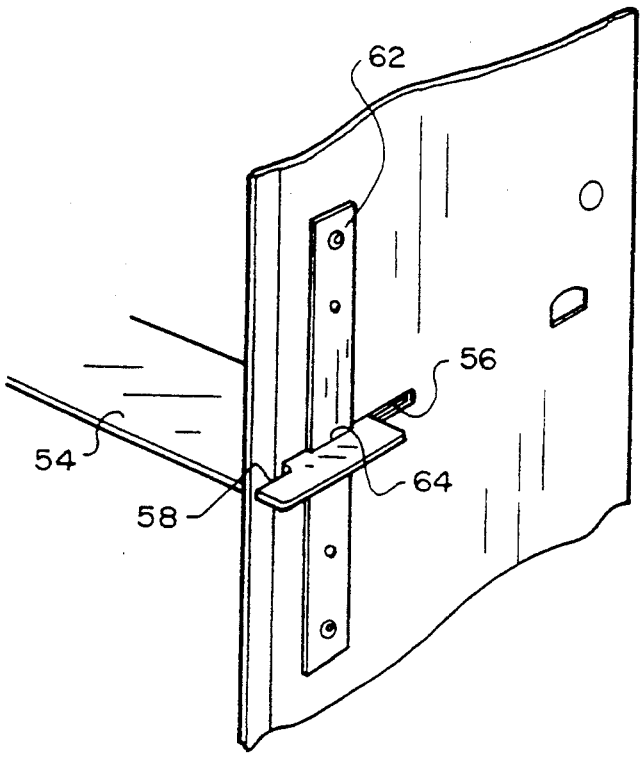
FIG. 5 is an enlarged, perspective view of the spreader retaining clip at the rack endwall of FIG. 3A.

As shown in FIGS. 4 and 5, a number of vertically-spaced, horizontal elements 54, called "spreaders," extend along the width of each rack 12, 14, and interlock the partition walls 38 of the troughs 22 forming each rack 12, 14. Each spreader 54 preferably comprises an elongate, flat strap that extends through elite 56 in the partition walls 38. The slits 56 are located Just to the rear of the trough-to-trough connecting features 42, and extend to a distance into the troughs 22 greater than the width of the spreaders 54.

Each spreader 54 includes interlocking notches 58 on its front edge at spaced locations along its length that correspond to the locations of the partition walls 38, and are used to maintain the spreaders 54 in place. During assembly, the spreaders 54 are "threaded" through the slits 56, and than pushed forwardly so as to receive the portions 38*a* of the partition walls 38 located forward of the slits 56 within the interlocking notches 58.

At the free ends of the rows 12*a*, 12*b* of stationary racks 12 and at the free ends of each movable rack 14, the spreaders 54 are locked into place by spreader lock bars or clips 62. Each spreader lock bar 62 is an elongate strip that is received through a slit 64 in the spreader proximate one of the spreader's ends that lie adjacent to the free-end side walls 24, 26. The lock bar 62 is secured to the exterior of that side wall, e.g., by bolts, rivets or other common expediency 68.

Accordingly, the spreaders 54 are maintained by the arrangement of the notch 58 receiving portions of the petition walls 38 and by the lock bar 62. Through use of this arrangement, the spreaders 54 bridge across the open front 16 of each trough 22, and brace the side walls 26, 24 so as to lend structural rigidity to the racks 12, 14.

Figure 6:
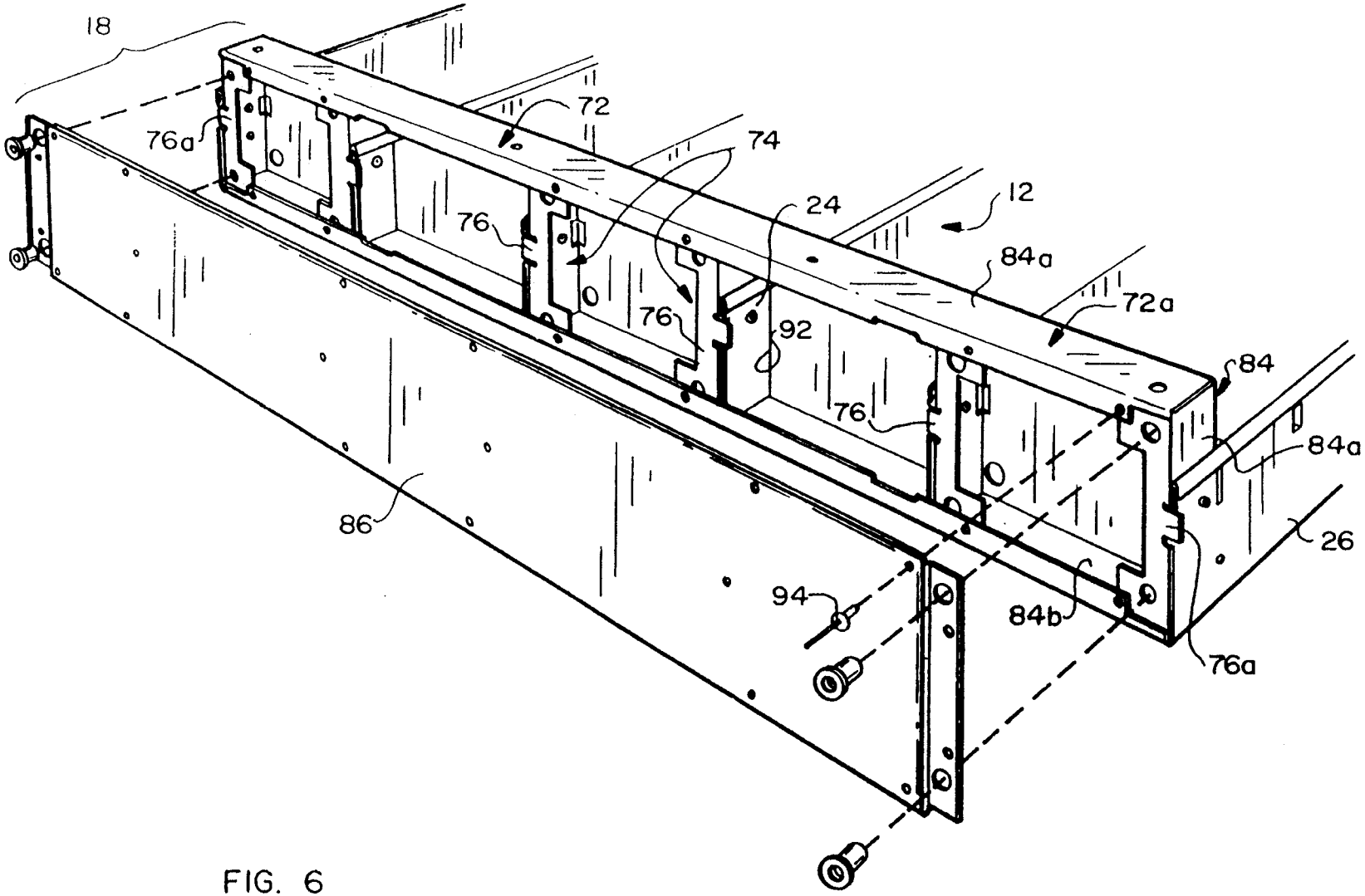
FIG. 6 is an exploded perspective view of the mounting base of each rack of the modular library system of FIG. 1.

FIG. 6 shows the "box within a box" construction of the mounting bases 18 for the racks 12, 14. (The base 18 in this view is actually for a stationary rack 12, because it is significantly wider than the rack connected to it. The bases 18 of the mobile racks 14 are of the same construction, except for that difference, and, for ease, we will only describe the illustrated base.) Each mounting base 18 includes an outer box 72, e.g., of sheet metal, and a plurality of inner boxes 74 comprising a pair of generally parallel bracing elements 76 that extend from the front to the rear of the rack.

More specifically, the outer box 72 has a top structure 72*a* preferably of unitary construction that extends the width of the rack 12. The top structure 72*a* includes a rectangular top wall 82 and side walls 84 that depend therefrom. The side walls 84 include a front wall 84*a*, a back wall 84*b* and end walls 84*c*. The outer box 72 also has a separate bottom wall 86.

The bracing elements 76 are each of a generally "C" shape, and are of rigid construction. The bracing elements 76 bridge between and are connected to the front and rear side walls at spaced locations therealong.

During assembly, the lower ends of the side and rear walls 24, 26, 28 of the troughs 22 are received through slits 92 in the top wall 82 of the outer box 72, and are, e.g., welded to the outer box 72. The trough side walls 24, 26 are also secured to the bracing elements 76, e.g., by riveting. Then, the bottom wall 86 is attached to the top structure 72*a* by a common expediency, such a rivets 94. The bottom wall 86 is also attached to the end-located bracing elements 76*a* by threaded inserts that preferably can serve as leveling glides for the rack 12.

Accordingly, the racks 12, 14 are of an improved design that provides structural rigidity owing to the double thick partition walls 38, the solid rear walls 28 of the troughs, the "box in a box" construction of the mounting bases 18, the tongue-in-groove trough interconnect system and the spreaders 54. This arrangement is designed so that the modular library system 10 can be readily expanded by the addition of racks 12 and/or 14, readily assembled and readily disassembled.

b. The Track Arrangements

With reference again to FIG. 1 and 2, the modular library system 10 has an upper and lower roller/track arrangement 120, 122 for guiding and facilitating the movement of each mobile rack 14. The upper roller/-track arrangement 120 includes a track 126 of a generally rectangular cross-section mounted on the top panel 20 of the stationary racks 12 of each row 12*a*, 12*b* along which the mobile racks 14 are to move. The track 126 extends substantially the length of the associated row 12*a*, 12*b*.

Figure 7:
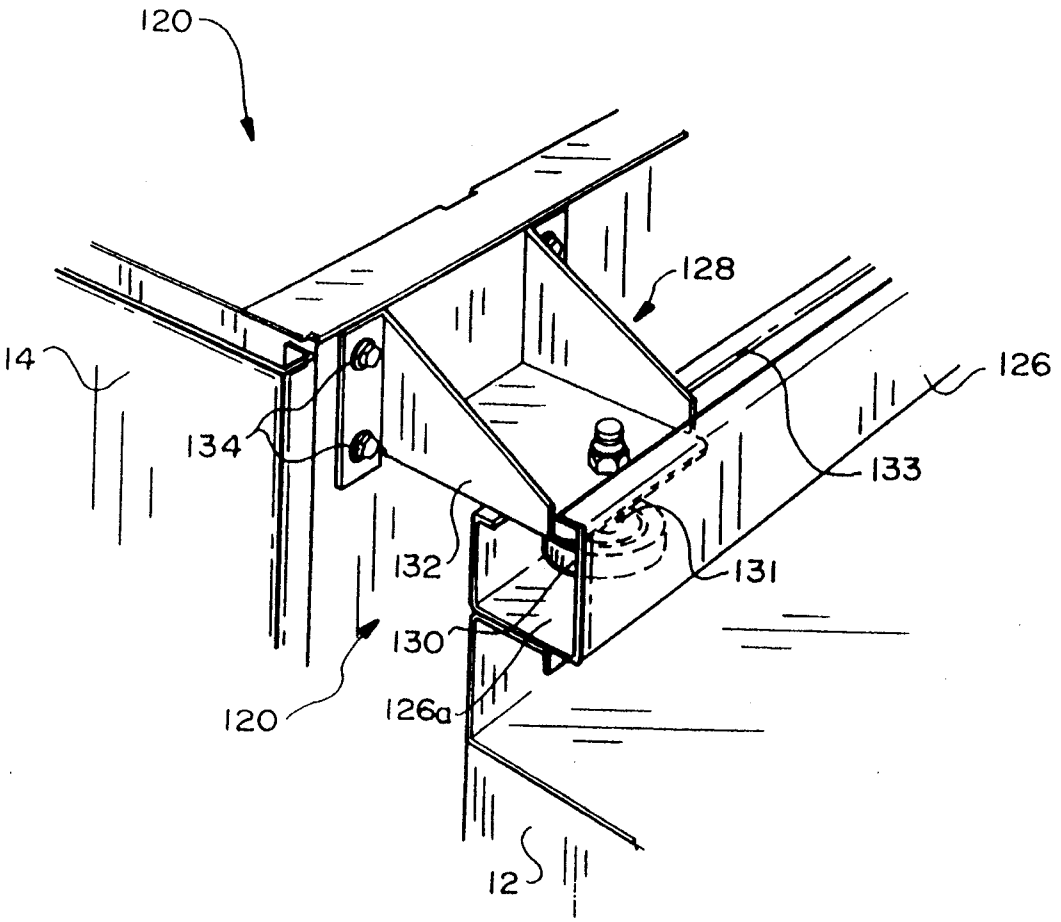
FIG. 7 is an exploded perspective view of the upper roller/track arrangement of the modular library system of FIG. 1.

With additional reference to FIG. 7, the upper roller/track arrangement 120 has a pair of horizontally spaced, upper roller assemblies 128 located at the rear of each mobile rack 14, near its end panels 15. Each roller assembly 128 includes a roller 130 and a bracket 132 for supporting the roller. The roller 130 is mounted on an axle 131 of the bracket 132 for rotation about a vertical axis. The bracket 132 is secured to the rear of the mobile rack 14 by conventional means, e.g., bolts 134.

Each roller 130 is received within the inner channel 126*a* of the associated upper track 126 for movement along its length. The axle 131 extends through an elongate opening 133 of the channel 126*a*. The portions of the upper track 126 on either side of the channel 126*a* form horizontal lips that serve to limit movement of the roller 130 in the vertical direction. Indeed, the roller 130 is constrained in its motion by the track 126 so as to be able to move substantially only in the horizontal direction along the open front 16 (FIG. 1) of the rack 12, so as to prevent accidental derailment.

Figure 8:
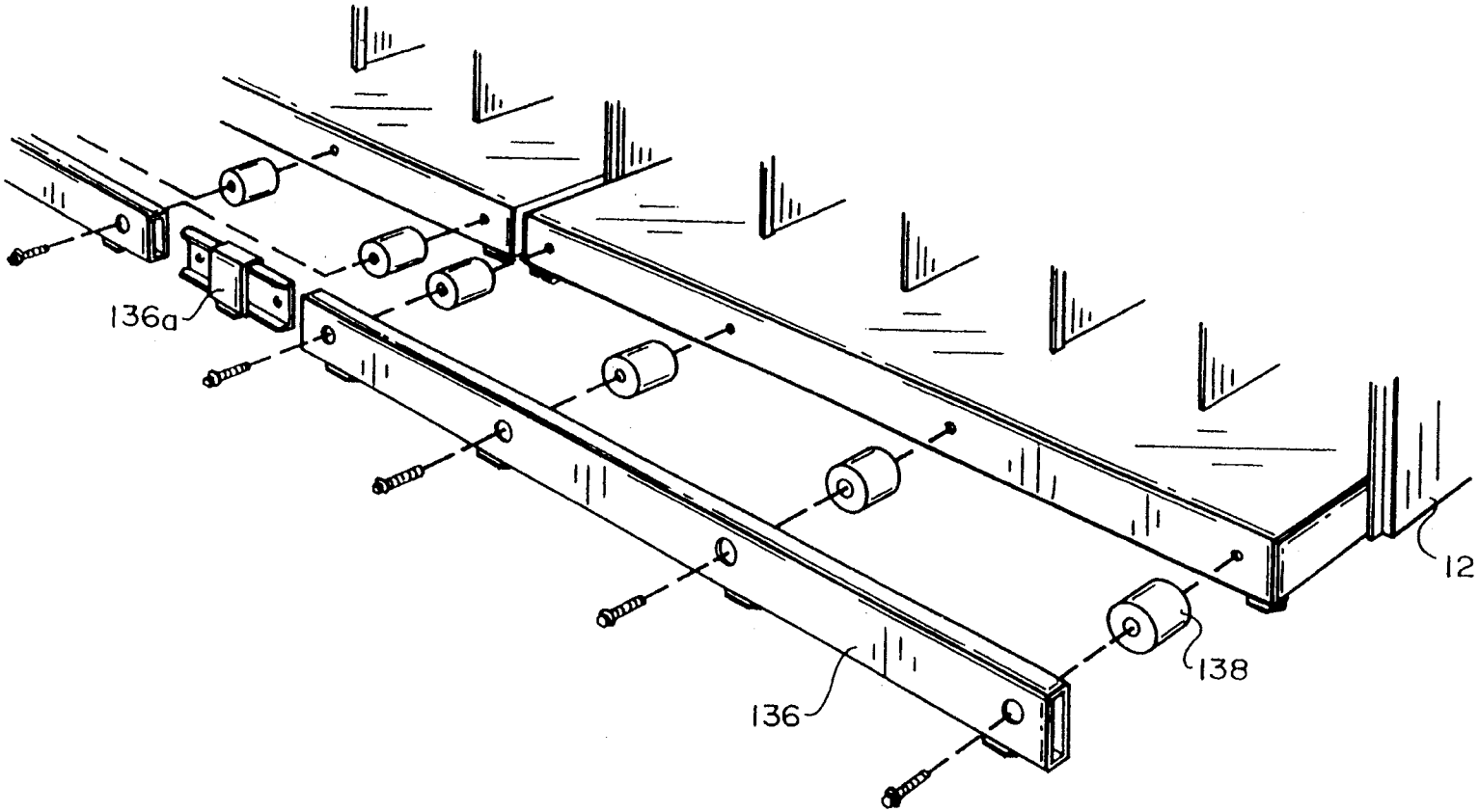
FIG. 8 is a perspective view of a portion of the lower roller/track arrangement of the modular library system of FIG. 1.

With reference to FIG. 8, the lower roller/track arrangement 122 includes a track 136, which is parallel to track 126 and is of rectangular cross-section. The track 136 is mounted to the front of the mounting bases 18 of an associated row 12*a*, 12*b* (FIG. 10) of stationary racks. The track 136 extends substantially the length of the associated row 12*a*, 12*b*.

A preferred arrangement for mounting the track 136 uses horizontally spaced mounting cylinders or spacers 138 located between the track 136 and the base 18. The cylinders 138 are secured by bolts 137, which extend through holes 139*a* in the track 136, holes 139*b* in the cylinders 138, and holes 139*c* in the base 18.

A track splicer 136*a* is used to bridge between and connect tracks 136 of adjacent stationary racks, and is held in place by the bolts 137 nearest the proximate ends of the tracks 136.

Returning to FIG. 1 and 2, the lower roller/track arrangement 122 also has a pair of horizontally spaced, lower roller assemblies 142 located under each mobile rack 14. Each roller assembly 128 includes a roller 144 mounted for rotation about a horizontal axis on a horizontal axle 145 supported by a bracket 146. The bracket 146 is mounted to the mobile rack 14 by conventional means (not shown). Each roller 144 rides on the lower track 136, and each pair supports the weight of the associated mobile rack 14.

c. The Brake System

The modular library system 10 also has a brake system 250 for slowing and stopping the motion of each mobile rack 14. The brake system 250 includes a brake assembly 252 mounted to the front of the mounting base 18 of each mobile rack 14, and a generally horizontal, wedge-shaped brake cam 254 mounted (e.g., by bolts 302, FIG. 10A) to the front of the lower track 136 so as to engage the brake at a selected first location along the track. In addition, the brake system 250 includes a safety stop 256 for positively preventing the mobile rack 14 from moving beyond a selected second location along the lower track 136 that is beyond the first location. The safety stop 256 prevents accidental derailment of the mobile rack 14.

Figure 9:
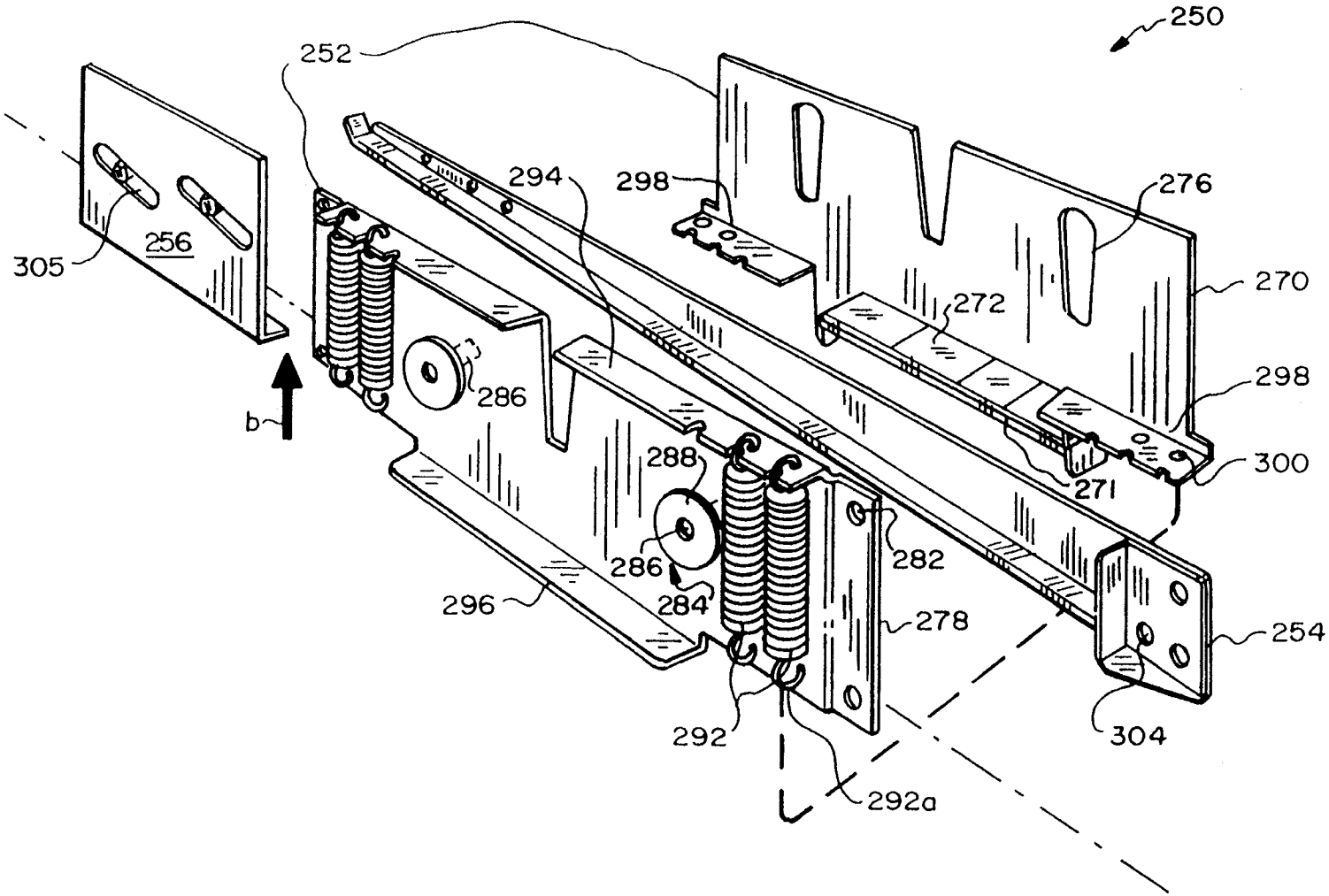
FIG. 9 is an exploded view of the brake system of the modular library system of FIG. 1.
Figure 10A:
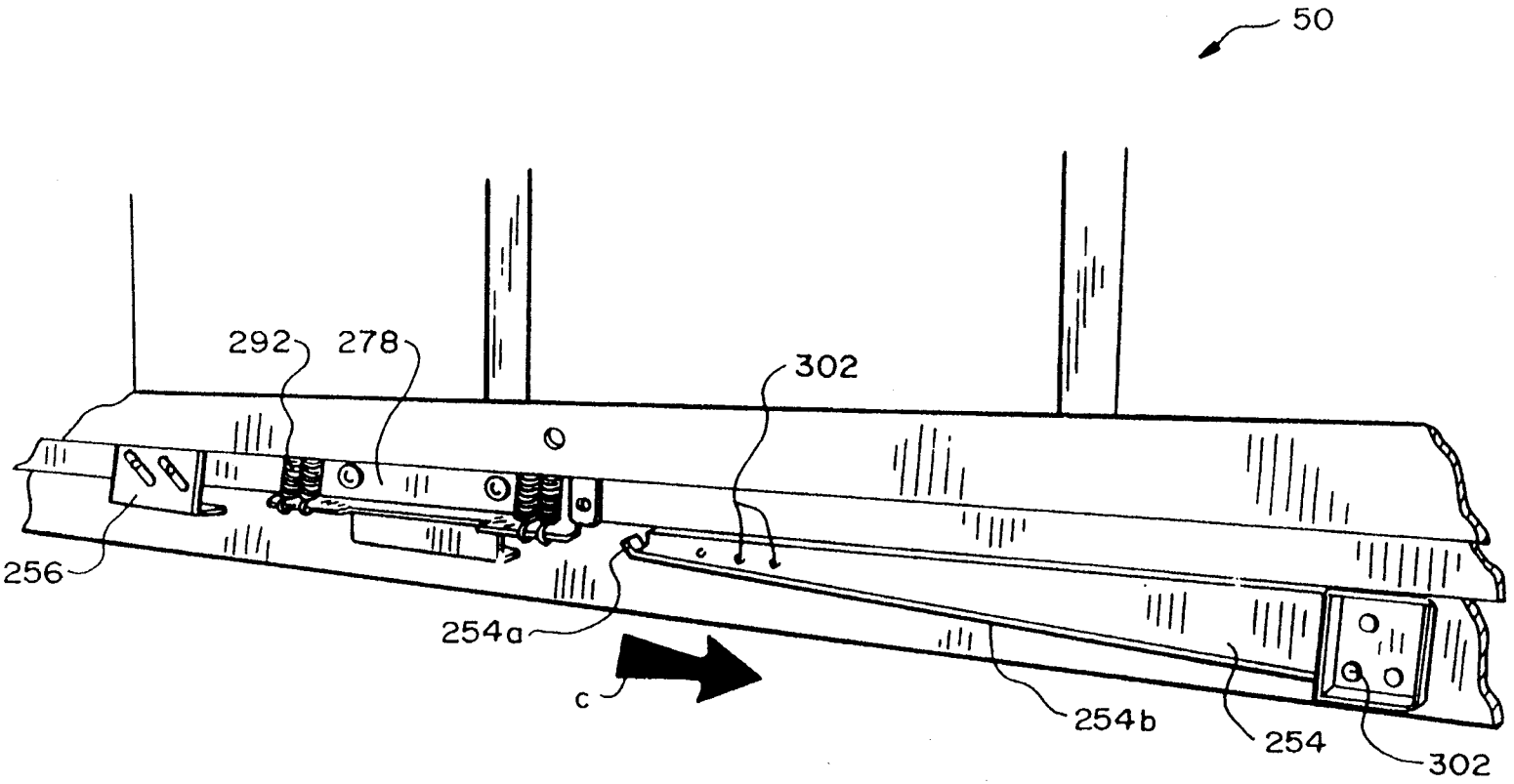
FIG. 10A and 10B are enlarged, perspective views of the brake system of FIG. 9 in respective disengaged and engaged positions.
Figure 10B:
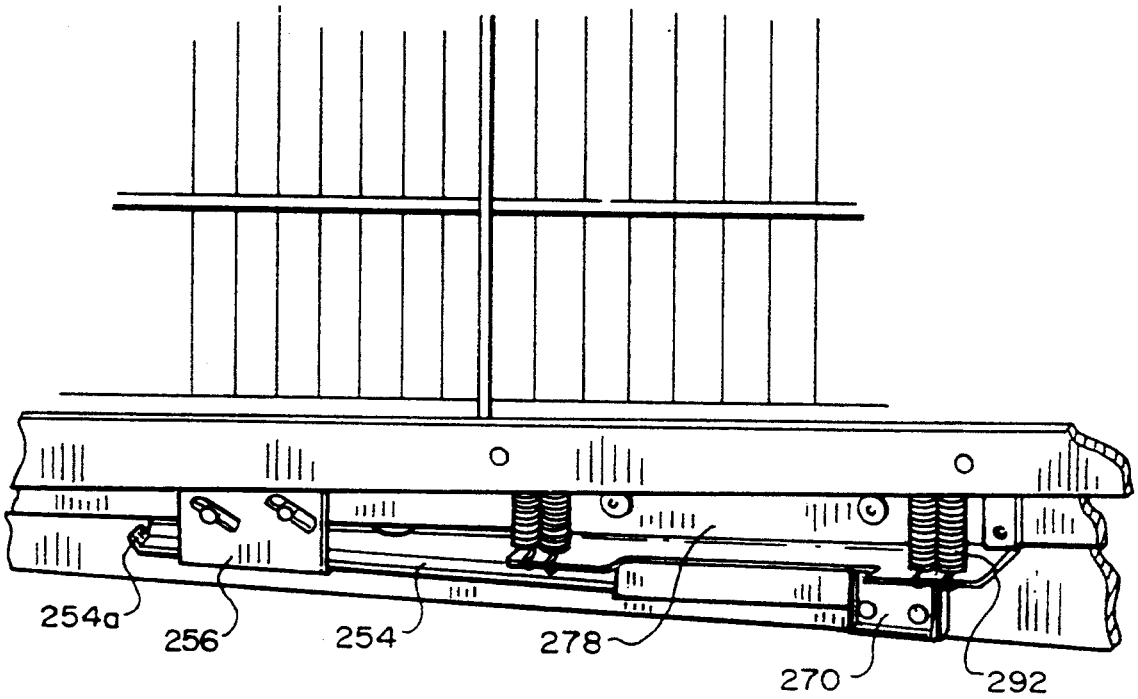

The brake system 250 is shown in greater detail in FIGS. 9, 10A and 10B, which depict it in an exploded view, and in views showing its disengaged position and engaged position, respectively. The brake assembly 252 includes a brake floating member 270 that has a horizontal plate 271 for supporting a brake wear pad 272 at a selected "normal" height, and a vertically oriented, rear guide plate 274 with a pair of vertically elongated guide slots 276.

The brake assembly 252 also has a mounting bracket 278 that can be mounted by conventional means (e.g., bolts, not shown) to the base 18 (FIG. 1). Mounting holes 282 are provide for that purpose. The mounting bracket 278 also has a pair of guide bushings 284 with central shafts 286 that are receivable through the guide slots 276, and with retention washers 288 that terminate the shafts 286. With this arrangement, the shafts 286 are forced to ride vertically within the guide slots 276, thereby guiding the motion of the floating member 270.

Two, spaced-apart sets of helical springs 292 are located near each end of the mounting bracket 278. The springs 292 are vertically oriented and mounted at a top end to a mounting tab 294 of the bracket 278 and are connectable at a lower end to the brake member 270 for biasing the brake member 270, during braking, in a vertically upward direction indicated by arrow "b" in response to deflection of the springs by the cam 254.

The brake assembly 252 is assembled by placing the brake floating member 270 on the mounting bracket 278, i.e., placing the guide bushings 284 through the guide slot 276. Then, the lower ends of the helical springs 292, which are provided with connection hooks 292*a* are placed through holes 300 of the brake floating member 270. Afterwards, the mounting bracket 278 is secured to the rack 14. With this arrangement, the helical springs 292 support the weight of the floating member 270, which is aptly named for obvious reasons.

After assembly, the wear pad 272 of the brake floating member 270 is located immediately under a wedge plate 296 of the mounting bracket 278. The wedge plate 296 is located within a channel formed by "U".shaped portions 298 of the brake floating member 270, which are located on each side of the wear pad 272. The distance between the wear pad 272 and the wedge plate 296 depends on the strength of the springs 292, which support all of the brake member's weight. This distance is important to the operation of the brake system 250. Accordingly, the brake system 250 will appear as shown in FIG. 10A when not engaged.

Upon movement of the mobile rack 14 in the direction of arrow "C," the brake cam 254 leading edge 254*a* will be driven between the wedge plate 296 and the wear pad 272, contacting the latter and driving the brake floating member 270 downwardly from its normal position against the bias of the helical springs 292. The frictional engagement of the brake cam 254 with the wear pad 272 due to the restoring forces in the springs causes gradual braking of the mobile rack 14. Due to the wedge shape of the brake cam 254, i.e., due to its lower wall 254*b* being sloped downwardly from its leading edge 254*a*, continued movement of the mobile rack 14 causes greater displacement of the floating member 270, and greater restoring forces to be developed. This causes the brake cam 254 to bear with greater force against the wear pad 272, resulting in even greater braking action.

The height of the normal position of the floating member 270 relative to the cam 254 will determine the point at which braking commences and is determined by the characteristics (e.g., spring constant and dimensions) of the helical springs 294. The helical springs 292 will determine the rate of deceleration as well.

The safety stop 256 will now be described. The safety stop 256 is secured to the mobile rack 14 by bolts 304 received through angled slots 305 in a mounting plate 306 of the stop 256. The stop 256 also includes a contact plate 308 whose height in the vertical direction relative to, e.g., the brake pad 272, is regulated by the location of the bolts 304 in the angled slots 305.

The height of the contact plate 308 is selected so that during operation, as seen best in FIG. 10B, the contact plate 308 bears against the brake cam 254 after a predetermined extent of travel of the mobile rack 14. This causes the mobile rack 14 to stop moving, and preferable occurs after the wear pad 272 has slowed the mobile rack appreciably. Accordingly, with this arrangement, the likelihood of the brake system jamming or causing derailment is reduced if not eliminated.

d. Alternative Embodiments

Figure 11:
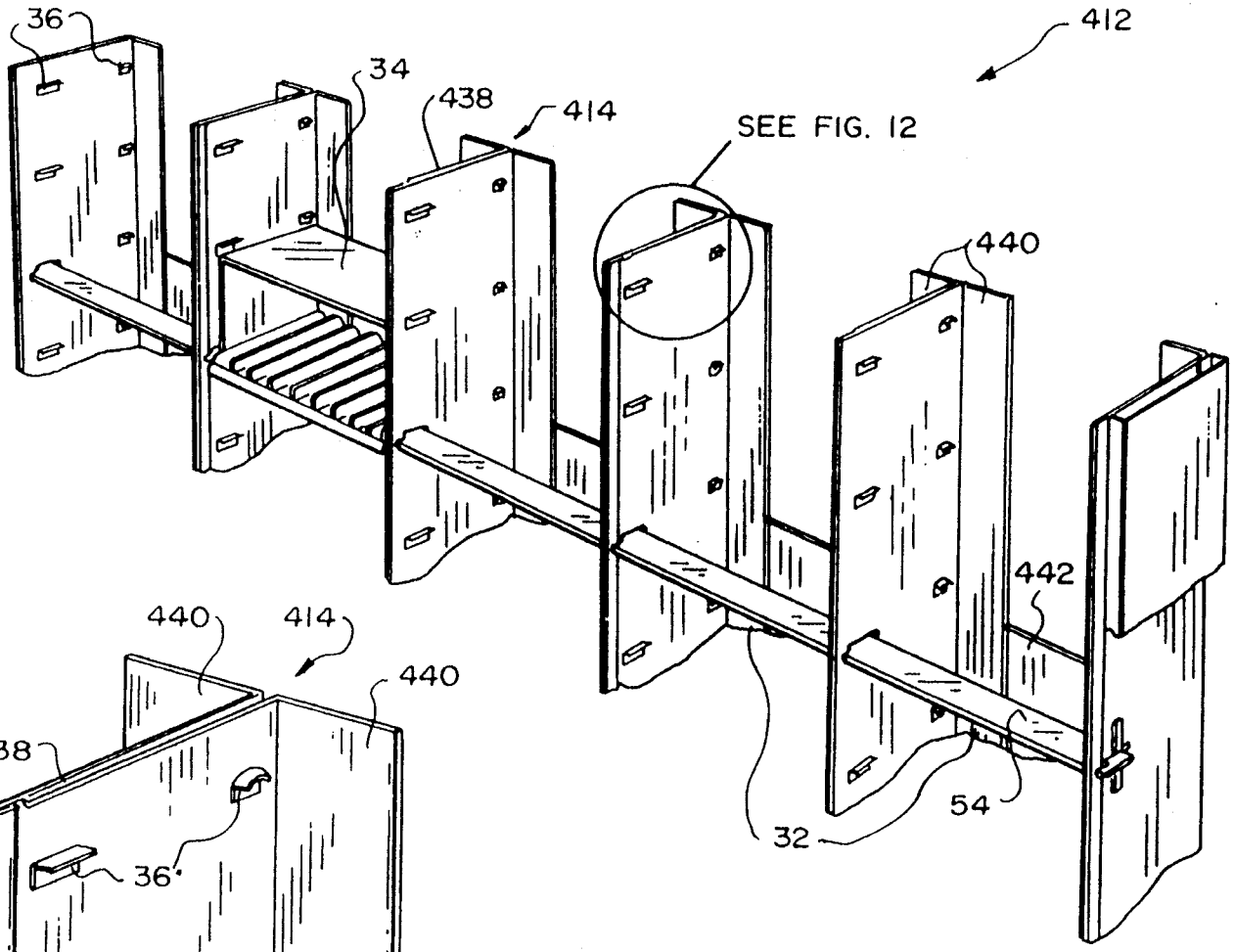
FIG. 11 is a perspective view of an alternate, "T" shaped construction embodiment of each rack of the modular library system in accordance with the invention.
Figure 12:
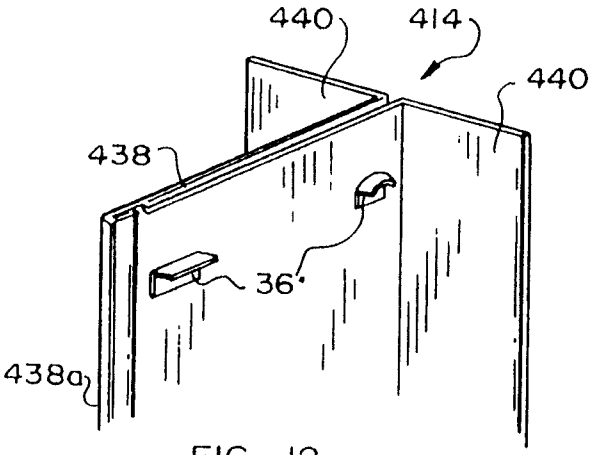
FIG. 12 is an enlarged, detail view of a portion of FIG. 11.

FIGS. 11–12 show the construction of a novel rack 412 in accordance with an alternative embodiment of the invention. The rack 412 is formed of a plurality of "T" shaped vertical supports 414, instead of the troughs described above. The T-supports 414, as they can be conveniently called, are each of unitary construction, being formed from, e.g., sheet metal that is bent over upon itself in the middle to provide the "central" elements 438 of the "T" shape, and then flared at ninety degrees at each end (distal from the bend 438*a*) to provide rear wall elements 440.

The central elements 438 form double-thick, rigid, vertical partition walls, which separate the cartridge-pack-receiving vertical spaces 32 within the rack 412. As with the other embodiment, the partition walls 438 have tray-supporting features 36 to retain the cartridge-holding trays 34. Preferably, the tray-supporting features 36 are formed by bending out short tabs of material from the T-supports 414 during manufacture, and thus do not require assembly with the T-supports.

The T-supports 414 are secured in an upright position and the rack 412 is provided with structural rigidity by use of a spreader 450, and by attachment of the T-supports 414 at one end to a top panel 20 (FIG. 1) and at the other to the bracing elements of the mounting base (as can be appreciated from FIG. 6). The spreader 450 and a planar, strip-like rear panel 442 serves to maintain the central elements of the T-supports parallel to one-another, and to maintain the vertical space at a substantially uniform rectangular cross-section for ready receipt of the cartridge-holding trays. (Preferably, the bracing elements for this embodiment extend in parallel relation with the central elements 438.) The rear panel 442, attached to the rear wall elements 440 of the T-supports 414 of each rack 412 interconnects the T-supports intermediate the top panel 20 and the mounting base.

Figure 13B:
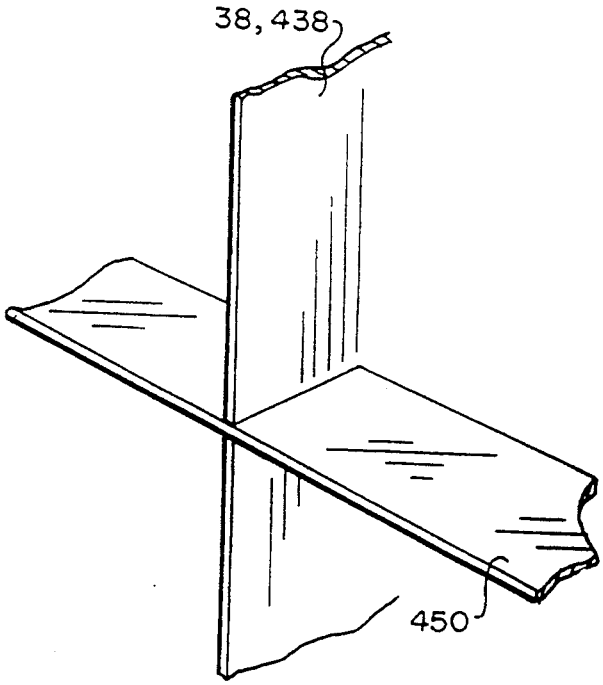
FIGS. 13A–13C are enlarged, perspective views of a spreader used in the embodiment of FIG. 11.
Figure 13A:
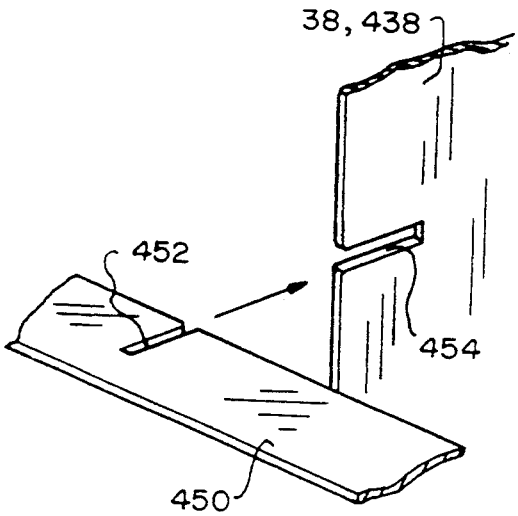

FIGS. 13A–13B shows the spreader 450 in greater detail. Spreader 450 has spaced notches 452 that interfit with forwardly located edge notches 454 on the partition walls 38, 438 when the spreader notches 452 are slid therein.

Figure 13C:
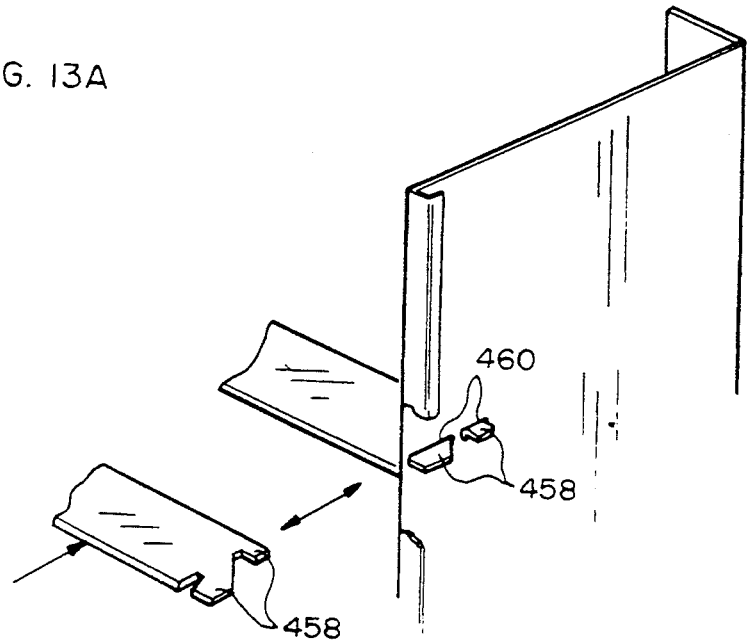

As shown in FIG. 13C, the spreader 450 interlocks with the supports located at each end of the rack 12, 412 by fitting locking tabs 458 located on the ends of the spreader 450 (and normally co-planar therewith) through mating slots 460 on those end supports, and then bending or twisting the tabs 458 (i.e., deforming them so as to not be co-planar with the spreader, as in the direction indicated by arrow "e") to lock the spreader 450 into the rack.

The foregoing description has been limited to a specific embodiment of this invention. It will be apparent, however, that variations and modifications may be made to the embodiment, with the attainment of some or all of the advantages of the invention. Therefore, it is the object of the appended claims to cover all such variations and modifications as come within the true spirit and scope of the invention.

What is claimed is:

1. A modular library system for computer cartridges comprising:

A) a plurality of stationary racks disposed side by side; and

B) at least one mobile rack coupled to and movable with respect to said stationary racks;

C) each of said stationary and mobile racks comprising 1) a plurality of "T" shaped vertical supports, each said vertical support being of integral, one-piece construction, and having a generally planar central element including a front bend, and first and second rear wall elements connected orthogonally to said central element at respective first and second locations distal to said front bend, said central element forming a double-thick, rigid, vertical partition wall, said partition walls of said "T" shaped supports forming a plurality of vertical spaces for receiving a plurality of cartridge-holding trays, and having a plurality of tray-supporting tabs to retain said cartridge-holding trays;

2) a top panel interconnecting said "T" shaped supports proximate a top end of said supports;

3) a mounting base interconnecting said "T" shaped supports proximate a bottom end of said supports, said mounting base including an outer box, and a plurality of bracing elements disposed within said outer box and extending in a direction parallel to said central elements and attached to said central elements; and 4) means for maintaining said "T" shaped supports generally parallel with one another, including a spreader for interconnecting said central elements proximate said central bends thereof and intermediate said top panel and said mounting base, and a planar, strip-like rear panel attached to said rear wall elements of said "T" shaped supports intermediate said top panel and said mounting base.

2. The modular rack system in accordance with claim 1, wherein said spreader includes a plurality of spaced notches that interfit with a plurality of forwardly located edge notches provided on said partition walls.

* * * * *